US005381667A

United States Patent [19]

Worley et al.

[11] Patent Number: 5,381,667

[45] Date of Patent: Jan. 17, 1995

[54] SYSTEM AND METHOD FOR MONITORING AND CONTROLLING NITROGEN PUMPING AT AN OIL OR GAS WELL

[75] Inventors: Thomas J. Worley; Charles E. Neal; Vincent P. Rivera, Duncan, all of Okla.

[73] Assignee: Halliburton Company, Duncan, Okla.

[21] Appl. No.: 83,961

[22] Filed: Jun. 25, 1993

[51] Int. Cl.[6] ..... F17C 9/02

[52] U.S. Cl. ..... 62/50.2; 62/49.1; 62/50.6

[58] Field of Search ..... 62/49.1, 50.2, 50.6

[56] References Cited

U.S. PATENT DOCUMENTS

| | | | |
|---|---|---|---|
| 2,521,199 | 9/1950 | Babcock | 62/50.2 X |
| 3,082,690 | 3/1963 | Reynolds et al. | 62/50.2 X |
| 3,091,096 | 5/1963 | Rendos et al. | 62/50.2 |
| 3,135,099 | 6/1964 | Holm | 62/50.2 |
| 3,753,626 | 8/1973 | Bacchi | 417/1 |
| 3,898,853 | 8/1975 | Iung | 62/55 |
| 3,925,048 | 12/1975 | Iung | 62/55 |
| 4,175,395 | 11/1979 | Prost et al. | 62/50.2 |
| 4,197,712 | 4/1980 | Zwick et al. | 62/50.2 |
| 4,409,927 | 10/1983 | Loesch et al. | 122/26 |
| 4,438,729 | 3/1984 | Loesch et al. | 122/26 |
| 4,458,633 | 7/1984 | Loesch deceased et al. | 122/26 |
| 4,627,243 | 12/1986 | Schaub | 62/50.2 |
| 4,712,607 | 12/1987 | Lindemans et al. | 62/51.1 X |
| 4,742,690 | 5/1988 | Linner | 62/51.1 X |
| 4,881,374 | 11/1989 | Mattiola et al. | 62/50.6 |

FOREIGN PATENT DOCUMENTS

| | | | |
|---|---|---|---|
| 2089022 | 6/1982 | United Kingdom | 62/50.2 |
| 2094461 | 9/1982 | United Kingdom | 62/50.2 |

*Primary Examiner*—Christopher Kilner

*Attorney, Agent, or Firm*—Stephen R. Christian; E. Harrison Gilbert, III

[57] ABSTRACT

A method and system provide automated, preferably electronic, monitoring and control of equipment used to pump and vaporize liquid nitrogen at an oil or gas well. The method comprises: pumping liquid nitrogen at the well; vaporizing pumped liquid nitrogen at the well; flowing vaporized nitrogen at the well; sensing temperature of the flowing vaporized nitrogen; sensing pressure of the flowing vaporized nitrogen; and automatically stopping the pumping of liquid nitrogen at the well when the sensed temperature is outside a predetermined temperature range or when the sensed pressure is outside a predetermined pressure range. A pre-stoppage warning can also be provided, and data about the vaporized nitrogen can be generated, displayed locally and transmitted remotely. A related system is also disclosed.

20 Claims, 3 Drawing Sheets

SYSTEM AND METHOD FOR MONITORING AND CONTROLLING NITROGEN PUMPING AT AN OIL OR GAS WELL

BACKGROUND OF THE INVENTION

This invention relates generally to a system and method for monitoring and controlling nitrogen pumping at an oil or gas well.

Numerous operations are performed on oil and gas wells which require large volumes of nitrogen gas. These operations may be performed on both onshore and offshore wells. Several examples are listed in U.S. Pat. No. 4,409,927 to Loesch et al., incorporated herein by reference. Although the present invention described hereinbelow can be used for the various oil or gas well applications requiring nitrogen gas, one particular application is on a barge from which a nitrogen stimulation job is to be performed at an offshore well.

It is known that during at least one type of an offshore nitrogen stimulation job, liquid nitrogen is pumped through a stainless steel manifolding to a sea water vaporizer in which the liquid nitrogen is heated and vaporized. Stainless steel manifolding at the outlet of the vaporizer connects to iron manifolding that conducts the vaporized nitrogen off the barge to the well or another vessel (e.g., a foaming vessel where the vaporized nitrogen is used to generate a foamed gel that is pumped into the well).

It is important to monitor the temperature at the stainless steel/iron manifolding joint to ensure that freezing temperatures are not present. The liquid nitrogen is stored at a very low temperature, such as −320° F., so that significant heating must occur for the vaporized nitrogen to be formed and brought to ambient or near ambient temperature. If the vaporized nitrogen is not heated to above a freezing temperature, the manifolding can become clogged by ice plugs. This presents a dangerous situation if the vaporized nitrogen continues to be produced because this can increase the pressure sufficiently whereby the manifolding explodes.

In an attempt to prevent such a dangerous situation arising, a temperature gauge has been placed near the manifolding junction so that an operator can locally read the temperature. If the temperature gets below a predetermined level, the operator stops the pumping by manually shifting into neutral a transmission that couples a drive motor to the liquid nitrogen pump. Although this can prevent an overpressurization of the type described above, it still presents a potentially hazardous situation because the operator is located at the situs of the nitrogen pumping and vaporizing equipment, which is typically carried forward on the barge.

To avoid this latter potentially hazardous situation where a person has to be located at the nitrogen pumping and vaporizing equipment, there is the need for a remote monitoring and controlling capability. This preferably should occur in an automated manner so that a person does not need to continually watch one or more gauges or manually operate the equipment.

SUMMARY OF THE INVENTION

The present invention overcomes the above-noted and other shortcomings of the prior art by providing a novel and improved system and method for monitoring and controlling nitrogen pumping at an oil or gas well. The present invention provides automated, preferably electronic, monitoring and control of equipment used to pump and vaporize liquid nitrogen at an oil or gas well. This preferably occurs from a location remote from the pumping and vaporizing equipment.

The present invention provides a system for monitoring and controlling nitrogen pumping at an oil or gas well, comprising: a liquid nitrogen vaporizer; pumping means for pumping liquid nitrogen from a source of liquid nitrogen to the vaporizer; a conduit connected to the vaporizer so that vaporized nitrogen enters the conduit; temperature sensing means for sensing temperature of vaporized nitrogen in the conduit; pressure sensing means for sensing pressure of vaporized nitrogen in the conduit; and control means, responsive to the temperature sensing means and the pressure sensing means, for automatically controlling the pumping means, the control means including: means for determining when a temperature sensed by the temperature sensing means is outside a predetermined temperature range; means for determining when a pressure sensed by the pressure sensing means is outside a predetermined pressure range; and means, responsive to both means for determining, for providing a control signal for stopping the pumping means from pumping liquid nitrogen from the source to the vaporizer when the sensed temperature is determined to be outside the predetermined temperature range or the sensed pressure is determined to be outside the predetermined pressure range.

The control means preferably further includes means for generating liquid nitrogen data in response to at least pressure sensed by the pressure sensing means; and the system preferably further comprises display means, connected to the control means, for displaying the liquid nitrogen data.

The control means preferably still further includes: means for determining when a temperature sensed by the temperature sensing means is outside a second predetermined temperature range; means for determining when a pressure sensed by the pressure sensing means is outside a second predetermined pressure range; and means for generating a warning signal when either the sensed temperature is determined to be outside the second predetermined temperature range or the sensed pressure is determined to be outside the second predetermined pressure range.

The present invention also provides a method of monitoring and controlling a nitrogen pumping process at an oil or gas well, comprising: pumping liquid nitrogen at an oil or gas well; vaporizing pumped liquid nitrogen at the well; flowing vaporized nitrogen at the well; sensing temperature of the flowing vaporized nitrogen; sensing pressure of the flowing vaporized nitrogen; and automatically stopping the pumping of liquid nitrogen at the well when the sensed temperature is outside a predetermined temperature range or when the sensed pressure is outside a predetermined pressure range.

The method preferably further comprises automatically generating a warning signal when the sensed temperature is outside a second predetermined temperature range or when the sensed pressure is outside a second predetermined pressure range.

The method preferably also further comprises generating data in response to at least one of the sensed temperature and pressure and displaying the data.

The present invention still further provides a method of monitoring and controlling a nitrogen pumping process at an offshore oil or gas well, comprising: transporting a liquid nitrogen pumping and vaporizing equipment on a floating vessel to an offshore oil or gas well location, the equipment disposed at a first situs on the vessel; operating the equipment at the offshore well location so that liquid nitrogen is pumped, vaporized and flowed through a conduit of the equipment to a location off the vessel; sensing a first temperature in the conduit and generating a first measurement signal in response to the sensed first temperature; sensing a second temperature in the conduit and generating a second measurement signal in response to the sensed second temperature; sensing a pressure in the conduit and generating a third measurement signal in response to the sensed pressure; sensing a flow rate in the conduit and generating a fourth measurement signal in response to the sensed flow rate; communicating the first, second, third and fourth measurement signals to an electrical controller disposed at a second situs on the vessel remote from the first situs; generating an electrical control signal in the controller in response to at least one of the four measurement signals; and communicating the control signal from the controller at the second situs on the vessel to a pumping control apparatus of the equipment at the first situs on the vessel so that the pumping control apparatus responds to the control signal and stops the pumping of liquid nitrogen at the first situs.

Preferably the step of generating the electrical control signal includes determining whether at least one of at least two conditions exists, wherein one condition exists when the first measurement signal represents a first temperature less than a predetermined temperature setpoint and another condition exists when the third measurement signal represents pressure greater than a predetermined pressure setpoint, and further wherein sensing the first temperature occurs upstream of sensing the second temperature relative to the flow of vaporized nitrogen through the outlet conduit. In conjunction with this, the method can further comprise generating a warning signal in response to either the first or third measurement signal when the sensed first temperature is less than a second predetermined temperature setpoint or when the sensed pressure is greater than a second predetermined pressure setpoint.

This offshore method can further comprise generating in the controller an electrical data signal representing vaporized nitrogen volume in response to the second, third and fourth measurement signals, and displaying at the second situs the vaporized nitrogen volume in response to the data signal. It can also comprise communicating the data signal to a third situs remote from the first situs and the second situs.

Therefore, from the foregoing, it is a general object of the present invention to provide a novel and improved system and method for monitoring and controlling nitrogen pumping at an oil or gas well. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

Figure 1:
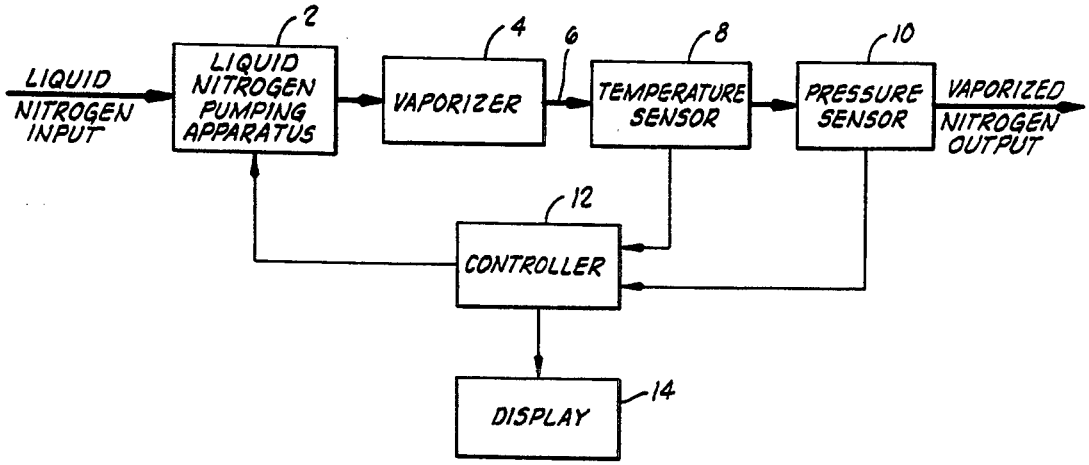
FIG. 1 is a block diagram of the system of the present invention for monitoring and controlling nitrogen pumping at an oil or gas well.

FIG. 1 depicts the broadest aspect of the system of the present invention. This system is for monitoring and controlling nitrogen pumping at an oil or gas well. Although in its broadest aspect the system can be used at oil or gas wells either on land or offshore, in a narrower preferred aspect the system is specific to offshore nitrogen pumping as will be described below with reference to FIGS. 2 and 3.

The system represented in FIG. 1 comprises conventional pumping apparatus 2 for pumping liquid nitrogen from a source of liquid nitrogen to a conventional liquid nitrogen vaporizer 4. The source of liquid nitrogen is not shown, but it is conventional as also known in the art. Examples of this equipment and the use of liquid nitrogen at oil or gas wells are disclosed in U.S. Pat. No. 4,409,927 to Loesch et al.; U.S. Pat. No. 4,438,729 to Loesch et al.; and U.S. Pat. No. 4,458,633 to Loesch deceased et al., all of which are incorporated herein by reference.

Still referring to FIG. 1, the system also comprises a conventional conduit 6 that is connected to the vaporizer 4 so that vaporized nitrogen from an outlet of the vaporizer 4 enters the conduit 6 and flows through it to a desired destination (e.g., into the well or into a foaming unit to create a foamed fracturing fluid).

A conventional temperature sensing means 8 is disposed in known manner in the conduit 6 downstream of the vaporizer 4 for sensing temperature of vaporized nitrogen in the conduit 6.

A conventional pressure sensing means 10 is disposed in known manner in the conduit 6 (downstream of the temperature sensing means 8 in FIG. 1, but not necessarily so) for sensing pressure of vaporized nitrogen in the conduit 6.

Unique to the system of the present invention is a controller 12 that provides control means for automatically controlling the pumping apparatus 2 in response to the temperature sensing means 8 and the pressure sensing means 10. The controller 12 preferably has other characteristics as will be more fully described below; however, one noted here is that it also includes means for generating data that can be locally or remotely displayed, such as by a display 14 connected to the control means 12.

The system represented in FIG. 1 can be used to perform a method of the present invention. Using the system, this method of monitoring and controlling a nitrogen pumping process at an oil or gas well comprises: pumping liquid nitrogen at the oil or gas well using the liquid nitrogen pumping apparatus 2; vaporizing pumped liquid nitrogen at the well using the vaporizer 4; flowing vaporized nitrogen at the well through the conduit 6 under pressure from the pumping apparatus 2; sensing temperature of the flowing vaporized nitrogen using the temperature sensor 8; sensing pressure of the flowing vaporized nitrogen using the pressure sensor 10; and automatically stopping, using the controller 12, the pumping of liquid nitrogen at the well when the sensed temperature is outside a predetermined temperature range (e.g., less than a predetermined temperature setpoint) or when the sensed pressure is outside a predetermined pressure range (e.g., greater than a predetermined pressure setpoint). The controller 12 is preferably also used to automatically generate a warning signal when the sensed temperature is outside a second predetermined temperature range that is preferably smaller than the first-mentioned predetermined temperature range (e.g., when the sensed temperature is less than a second predetermined temperature setpoint which preferably is set at a value greater than the first-mentioned predetermined temperature setpoint so that the low temperature warning first occurs before the pump stopping temperature condition occurs). The controller 12 preferably also automatically generates a warning signal when the sensed pressure is outside a second predetermined pressure range that is preferably smaller than the first-mentioned predetermined pressure range (e.g., when the sensed pressure is greater than a second predetermined pressure setpoint which preferably is set at a value less than the first-mentioned predetermined pressure setpoint so that the high pressure warning first occurs before the pump stopping pressure condition occurs). The controller 12 can further be used to generate data in response to at least one of the sensed temperature and pressure and to cause the data to be displayed through the display 14.

The system and method described generally above will be more particularly described with reference to FIGS. 2 and 3 and within the context of solving a particular problem that has previously existed with regard to pumping and vaporizing liquid nitrogen at an offshore well, namely, how to automatically and more safely control the liquid nitrogen pumping and vaporizing equipment when it is used offshore.

Figure 2:
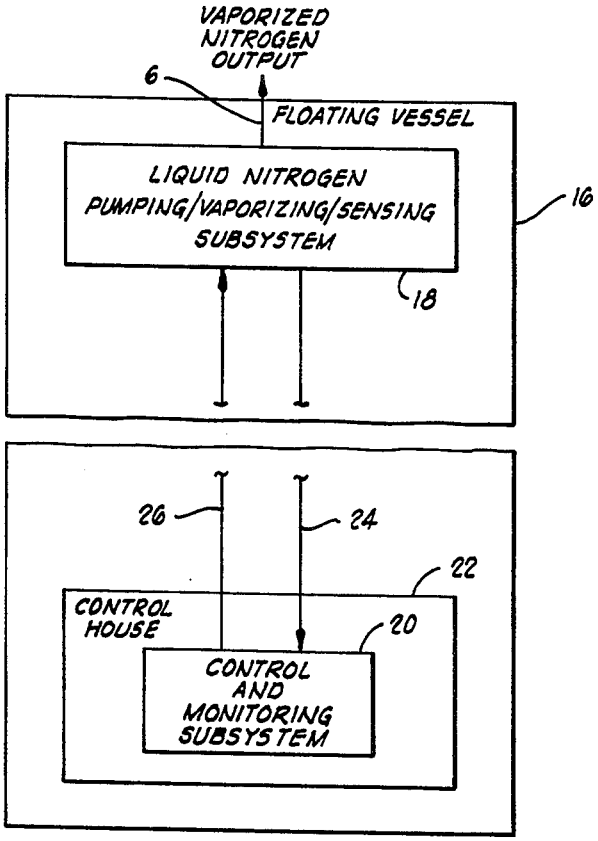
FIG. 2 is a block diagram representing the system of the present invention on a floating vessel, such as a barge, for use at an offshore well.

Referring first to FIG. 2, a floating vessel 16 is represented. An example of the vessel 16 is a barge of known type, such as one of the type used by Halliburton Services division of Halliburton Company. The vessel 16 carries a liquid nitrogen pumping/vaporizing/sensing subsystem 18. Such a subsystem is known in the art, and it includes the liquid nitrogen pumping apparatus 2, the vaporizer 4, the temperature sensor 8 and the pressure sensor 10 shown in FIG. 1 as will be further discussed below. The equipment of the subsystem 18 is typically located forward of a control house of the vessel 16 for use at offshore wells in known manner.

In accordance with the present invention, the vessel 16 also carries a control and monitoring subsystem 20, which includes the controller 12 and the display 14 depicted in FIG. 1. This subsystem is preferably located inside a control house 22 found amidships or aft of typical barges used at offshore oil or gas wells; thus, the control and monitoring subsystem 20 is remote from the liquid nitrogen pumping/vaporizing/sensing subsystem 18. The control house 22 typically contains other monitoring and control equipment not germane to a description of the present invention.

Communication between the remotely located subsystems 18, 20 can be established by any signal transmission medium that provides sufficiently errorless data transfer. In the preferred embodiment, electrical wire communication paths are provided. Input from the subsystem 18 is received over one or more wires 24, and output to the subsystem 18 is transmitted over one or more wires 26.

With the arrangement of parts as represented in FIG. 2, the present invention can automatically and safely control the operation of the subsystem 18 from the remote site of the controller 12 and display 14 rather than at the local site of the subsystem 18.

Figure 3:
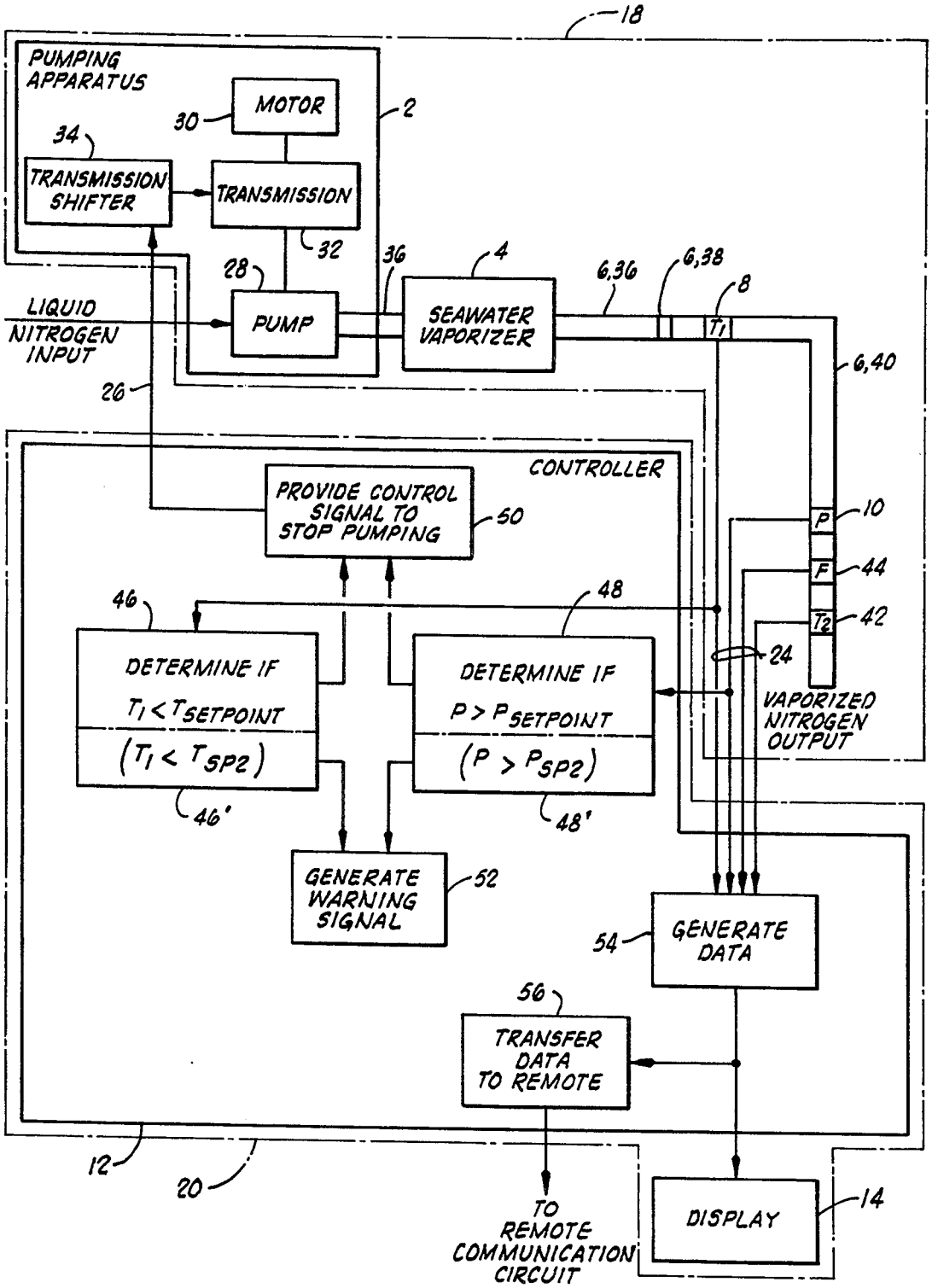
FIG. 3 is a more detailed block diagram of the preferred embodiment of the present invention as used on the floating vessel depicted in FIG. 2.

The subsystems 18, 20 of the FIG. 2 embodiment are more particularly shown in FIG. 3. The liquid nitrogen pumping/vaporizing/sensing subsystem 18 includes the liquid nitrogen pumping apparatus 2 shown in FIG. 3 as particularly including a liquid nitrogen pump 28 (e.g., a Halliburton HT400 pump) having its suction side connected to the liquid nitrogen source and its discharge side connected to the liquid nitrogen vaporizer 4 through respective fluid communication lines. The pumping apparatus 2 also includes an engine 30 (e.g., Detroit 16V92) that drives the pump 28 through a transmission 32 connected to the respective drive shafts of the motor 30 and the pump 28. The pumping apparatus 2 further includes transmission shifting means 34, such as a 6061 electric solenoid. The transmission shifting means 34 is connected to the transmission 32 and the control means 12 for shifting the transmission 32 to a neutral gear setting in response to a control signal from the control means 12. The aforementioned equipment and their interconnections are known in the art.

The vaporizer 4 is shown in FIG. 3 as particularly embodied by a conventional seawater vaporizer, such as a Cryomec brand; its operation is also conventional and known. The seawater vaporizer 4 is connected to the discharge side of the pump 28 by a stainless steel manifold 36 of a type conventionally used as known in the art. The stainless steel manifold 36 extends through the vaporizer 4 and connects at a joint 38 to an iron manifold 40 as also known in the art. The manifolds 36, 40 and the joint 38 make up at least part of the conduit 6 represented in FIG. 1.

Disposed in known manner in the iron manifold 40 are the temperature sensor 8 (e.g., an ITE model T3000) and the pressure sensor 10 (e.g., a Viatran P/N 5093BP6T25AO). Another temperature sensor 42 of the same type as the temperature sensor 8 and a flow rate sensor 44 (e.g., Halliburton turbine flow meter) are also disposed in known manner in the iron manifold 40. Each of these sensors detects its respective parameter of the vaporized nitrogen flowing through the iron manifold 40 and, in response, generates in known manner a respective electrical signal. These electrical signals are communicated to the controller 12 over the one or more signal input wires 24.

Referring now to the more particular description of the control and monitoring subsystem 20 as shown in FIG. 3, the controller 12 thereof can be any suitable control device, circuit or system; however, it preferably includes a digital computer programmed to provide the various means shown in FIG. 3 and described further below. It is contemplated that a programmable logic controller (PLC) can be used. A specific device that can be used is the UNI-PRO II process controller from Halliburton Services. It is preferably programmed to implement the monitoring and control functions described herein. Such programming is within the ordinary skill in the art given the description made herein.

Referring to the particular implementation of FIG. 3, the programmed controller 12 includes means 46 for determining when a temperature sensed by the temperature sensing means 8 is less than a predetermined temperature setpoint. This temperature setpoint is entered into the controller 12 through a data entry device such as, for example, a keypad or keyboard or within the programming; it is preferably set at a temperature level above a temperature where freezing is likely to occur given particular operating conditions, such as moisture content of the nitrogen, ambient temperature, etc. Such a temperature may be below 32° F. (e.g., 20° F.). The sensed temperature is obtained by the controller 12 in response to the signal transmitted over the respective wire 24 from the temperature sensor 8. A software-implemented comparison is made in a conventional manner to determine whether the sensed temperature is less than the temperature setpoint.

The programmed controller 12 includes means 48 for determining when a pressure sensed by the pressure sensing means 10 is greater than a predetermined pressure setpoint. This pressure setpoint is also entered into the controller 12 through a data entry device such as, for example, a keypad or keyboard or within the programming; it is preferably set at a pressure level below which dangerously high pressure conditions will not exist (e.g., 12,000 pounds per square inch). The sensed pressure is obtained by the controller 12 in response to the signal transmitted over the respective wire 24 from the pressure sensor 10. A software-implemented comparison is made in a conventional manner to determine whether the sensed pressure is greater than the pressure setpoint.

The programmed controller 12 further includes means 50 for providing a control signal for stopping the pumping means 2 from pumping liquid nitrogen from the source to the vaporizer 4 in response to either of the aforementioned means 46, 48 determining that a shutdown condition exists (i.e., the sensed temperature is too low or the sensed pressure is too high). For example, in response to either such condition being sensed, the means 50, as implemented with a relatively low output current UNI-PRO II controller, provides a ten-volt signal to a coil of an actuating solenoid located at the controller site. This closes the switch mechanism of the actuating solenoid. The closed switch mechanism connects a higher current power supply at the site of the subsystem 20 to the transmission solenoid 34 at the site of the subsystem 18, thereby shifting the transmission to neutral. If the temperature and pressure are within their allowable limits, the UNI-PRO II controller provides a zero-volt output so that the switch mechanism of the actuating solenoid is open, whereby the transmission solenoid is not energized to shift to neutral. In this particular implementation, it is the higher current signal that is transmitted from the site of the control and monitoring subsystem 20 to the site of the liquid nitrogen pumping/vaporizing/sensing subsystem 18.

If it is desired that a warning be given before a shutdown condition as just described occurs, the programmed controller 12 can also include: (1) means 46' for determining when a temperature sensed by the temperature sensing means 8 is less than a second predetermined temperature setpoint ($T_{SP2}$ in FIG. 3) which is preferably set at a value greater than the first-mentioned predetermined temperature setpoint ($T_{SETPOINT}$ in FIG. 3) of the means 46, and (2) means 48' for determining when a pressure sensed by the pressure sensing means 10 is greater than a second predetermined pressure setpoint ($P_{SP2}$ in FIG. 3) which is preferably set at a value less than the first-mentioned predetermined pressure setpoint ($P_{SETPOINT}$ in FIG. 3) of the means 48. An example of $T_{SP2}$ is 30° F., and an example of $P_{SP2}$ is 10,000 psi. The determinations referred to in this paragraph are made in the same manner as for the means 46, 48.

To respond to such a warning condition, the programmed controller 12 further includes means 52 for generating a warning signal when either the sensed temperature is in the temperature warning zone or the sensed pressure is in the pressure warning zone. For example, in response to either such condition being sensed, the means 52 activates one or more suitable devices, such as a horn or a light.

Figure 4:
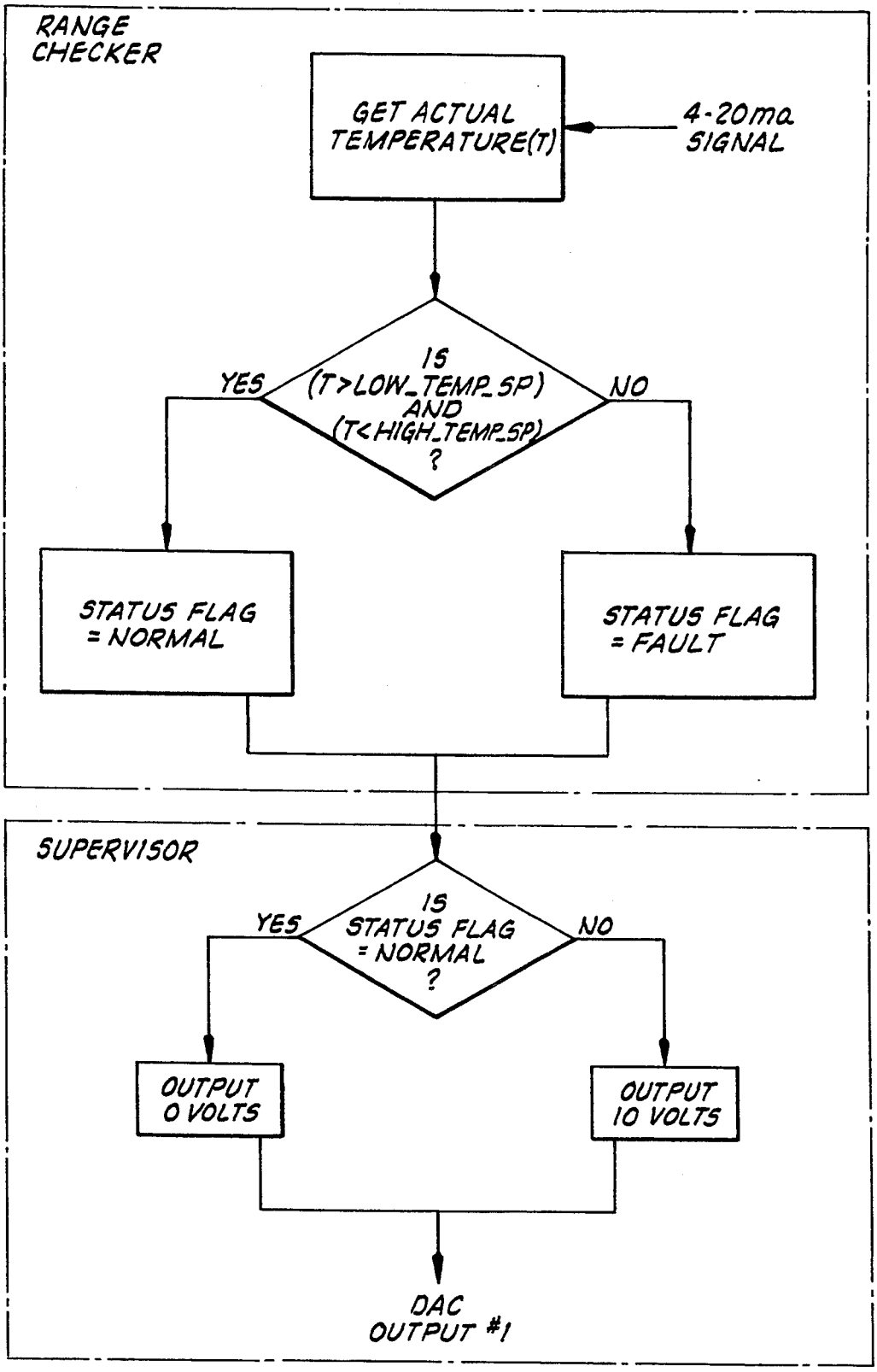
FIG. 4 is a flow chart of a program for implementing pump shutdown due to an out-of-range temperature being sensed, but it is also applicable to pressure control and both temperature and pressure warning control.

Although FIG. 3 and the present invention are specifically concerned with sensing a too low temperature condition and a too high pressure condition, in its broader aspects the invention generally is concerned with any temperature condition outside a predetermined temperature range and any pressure condition outside a predetermined pressure range. The FIG. 3 embodiment is an example where each of these ranges is defined by a single respective setpoint (i.e., a normal range is to one side of the setpoint and an abnormal range is to the other side of the setpoint). FIG. 4 is a computer program flow chart for a temperature-transmission control method wherein the predetermined temperature range is between two setpoints, thereby defining both high and low temperature conditions where pump stoppage occurs. This same flow chart also represents the pump stoppage control due to out-of-range pressure and temperature and pressure warning conditions if a respective desired two-setpoint range is substituted for the temperature range of FIG. 4.

As further represented in FIG. 3, the programmed controller 12 can include means 54 for generating liquid nitrogen data in response to at least pressure sensed by the pressure sensing means 10. The means 54 can compute each of the respectively sensed parameters and it also can, for example, be defined to calculate the flow volume of vaporized nitrogen. This latter calculation is made using the pressure, temperature and flow rate sensed by the sensors 10, 42, 44, respectively. The equation for such calculation is nitrogen volume (scf)=acf*(n2dens/n2stddens), where scf=standard cubic feet, acf=actual cubic feet, n2dens=nitrogen density and n2stddens=nitrogen standard density. The means 54 is implemented in software in the preferred embodiment of FIG. 3.

The calculated data can be output for display via the display 14, which may include a strip chart recorder (e.g, a Kodak Diconix printer), a liquid crystal display, a video monitor or any other suitable device or devices. The calculated data can also be communicated elsewhere via means 56 for transferring the data to a location remote from the control and monitoring subsystem 20. In a specific implementation this communication is over a local area network, such as one using the Halliburton Services ILAN protocol. For example, communication can be from one barge to another barge. Such means 56 is implemented by Halliburton Services ILAN protocol.

A specific implementation of the foregoing provides for the remote display, recording and strip-charting of vaporized nitrogen information during a stimulation treatment. Nitrogen flow rate, temperature and pressure are all displayed and strip-charted by the particular implementation under control of a suitably programmed Halliburton Services UNI-PRO II process controller. The volume of vaporized nitrogen delivered is calculated from these sensor inputs and displayed. From the temperature sensor 8 placed near where the stainless steel manifolding meets the iron manifolding, a signal that can be used to indicate a warning condition or a shutdown condition is provided. This indication can also be provided in response to pressure sensed via the pressure sensor 10. If a warning condition is detected, a warning signal is given; if a shutdown condition is detected, a signal causing the transmission shifter 34 to shift the transmission 32 into neutral is given.

Applying the present invention specifically to an offshore environment, the present invention provides a method of monitoring and controlling a nitrogen pumping process at an offshore oil or gas well. Liquid nitrogen pumping and vaporizing equipment of the subsystem 18 in the embodiment of FIGS. 2 and 3 is transported on the floating vessel 16 to the offshore oil or gas well location. As described above with reference to FIG. 2, the equipment of the subsystem 18 is disposed at a first situs on the vessel 16.

The equipment of the subsystem 18 is operated at the offshore well location so that liquid nitrogen is pumped, vaporized and flowed through the conduit 6 to a location off the vessel 16 as also illustrated in FIG. 2. While this occurs, temperature in the conduit 6 is sensed by the temperature sensor 8 and a respective measurement signal is generated in response. Temperature in the conduit 6 is also sensed by the temperature sensor 42 and a respective measurement signal is generated in response. Sensing by the temperature sensor 8 occurs upstream of sensing by the temperature sensor 42 relative to the flow of vaporized nitrogen through the conduit 6. A pressure in the conduit 6 is sensed by the pressure sensor 10 and a respective measurement signal is generated in response. A flow rate in the conduit 6 is sensed by the flow meter 44 and a respective measurement signal is generated in response. These four measurement signals are communicated via the wire(s) 24 to the electrical controller 12 disposed at a second situs on the vessel 16 remote from the first situs where the aforementioned mechanical subsystem 18 is disposed.

The controller 12 generates an electrical control signal in response to at least one of these four measurement signals. In accordance with the preceding description of the present invention, generating the control signal includes determining whether at least one of at least two conditions exists: one condition exists when the measurement signal from the temperature sensor 8 represents a temperature outside a predetermined range (such as less than a predetermined temperature setpoint), and another condition exists when the measurement signal from the pressure sensor 10 represents pressure outside a predetermined range (such as greater than a predetermined pressure setpoint). If either of these conditions occurs, as explained above the controller 12 automatically stops the pumping of liquid nitrogen by generating an appropriate electrical control signal and communicating the control signal from the controller 12 at the second situs on the vessel 16 to the transmission shifting apparatus 34 at the first situs on the vessel 16 so that the transmission shifting apparatus 34 shifts the transmission 32 at the first situs into neutral.

This method can further comprise additional steps of the same type as referred to above concerning providing a warning signal before a shutdown condition is detected, generating data, locally displaying the data and remotely communicating the data.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A system for monitoring and controlling nitrogen pumping at an oil or gas well, comprising:

a liquid nitrogen vaporizer;

pumping means for pumping liquid nitrogen from a source of liquid nitrogen to said vaporizer;

a conduit connected to said vaporizer so that vaporized nitrogen enters said conduit;

temperature sensing means for sensing temperature of vaporized nitrogen in said conduit;

pressure sensing means for sensing pressure of vaporized nitrogen in said conduit; and control means, responsive to said temperature sensing means and said pressure sensing means and connected to said pumping means, for automatically controlling said pumping means, said control means including:

means for determining when a temperature of vaporized nitrogen in said conduit sensed by said temperature sensing means is outside a predetermined temperature range;

means for determining when a pressure of vaporized nitrogen in said conduit sensed by said pressure sensing means is outside a predetermined pressure range; and means, responsive to both said means for determining, for providing a control signal for stopping said pumping means from pumping liquid nitrogen from said source to said vaporizer when the sensed temperature is determined to be outside the predetermined temperature range or the sensed pressure is determined to be outside the predetermined pressure range.

2. A system as defined in claim 1, wherein said pumping means includes:

a pump connected to said liquid nitrogen source and said liquid nitrogen vaporizer;

a motor;

a transmission connected to said motor and said pump; and transmission shifting means, connected to said transmission and said control means, for shifting said transmission to a neutral gear setting in response to the control signal.

3. A system as defined in claim 1, wherein:

said control means further includes means for generating liquid nitrogen data in response to at least pressure sensed by said pressure sensing means; and said system further comprises display means, connected to said control means, for displaying said liquid nitrogen data.

4. A system as defined in claim 3, wherein said display means includes a strip chart recorder.

5. A system as defined in claim 3, wherein said control means further includes means for transferring said data to a location remote from said control means.

6. A system as defined in claim 1, wherein said control means further includes:

means for determining when a temperature sensed by said temperature sensing means is outside a second predetermined temperature range;

means for determining when a pressure sensed by said pressure sensing means is outside a second predetermined pressure range; and means for generating a warning signal when either the sensed temperature is determined to be outside the second predetermined temperature range or the sensed pressure is determined to be outside the second predetermined pressure range, wherein the second predetermined temperature range is defined relative to the first-mentioned predetermined temperature range and the second predetermined pressure range is defined relative to the first-mentioned predetermined pressure range so that a generated warning signal occurs before a said control signal for stopping said pumping means is provided.

7. A method of monitoring and controlling a nitrogen pumping process at an oil or gas well, comprising:

pumping liquid nitrogen at an oil or gas well;

vaporizing pumped liquid nitrogen at the well;

flowing vaporized nitrogen at the well through a conduit connected at a joint to receive the vaporized nitrogen;

sensing temperature of the flowing vaporized nitrogen adjacent the joint;

sensing pressure of the flowing vaporized nitrogen in the conduit; and automatically stopping the pumping of liquid nitrogen at the well when the sensed temperature adjacent the joint is less than a predetermined temperature setpoint indicating a near freezing condition in the conduit adjacent the joint or when the sensed pressure in the conduit is greater than a predetermined pressure setpoint indicating an incipient clogged conduit condition.

8. A method as defined in claim 7, further comprising automatically generating a warning signal when the sensed temperature is less than a second predetermined temperature setpoint which is greater than the first-mentioned predetermined temperature setpoint or when the sensed pressure is greater than a second predetermined pressure setpoint which is less than the first-mentioned predetermined pressure setpoint.

9. A method as defined in claim 7, further comprising generating data in response to at least one of the sensed temperature and pressure and displaying the data.

10. A method as defined in claim 9, wherein the data is displayed on a strip chart recorder.

11. A method as defined in claim 7, wherein automatically stopping the pumping of liquid nitrogen includes generating an electrical control signal and communicating the control signal to a transmission shifting apparatus so that the transmission shifting apparatus shifts a transmission of a liquid nitrogen pumping apparatus into neutral in response to the control signal.

12. A method as defined in claim 7, wherein automatically stopping the pumping of liquid nitrogen includes:

electrically processing, remote from where the temperature and pressure are sensed, electrical measurement signals representing the sensed temperature and pressure;

generating, remote from where the liquid nitrogen is pumped, an electrical control signal in response to electrically processing the electrical measurement signals; and communicating the electrical control signal to where the liquid nitrogen is pumped so that the pumping stops in response to the communicated control signal.

13. A method as defined in claim 12, further comprising automatically generating a warning signal when the sensed temperature is outside a second predetermined temperature range or when the sensed pressure is outside a second predetermined pressure range.

14. A method as defined in claim 13, further comprising generating data in response to at least one of the sensed temperature and pressure and displaying the data.

15. A method as defined in claim 14, wherein the data is displayed on a strip chart recorder.

16. A method of monitoring and controlling a nitrogen pumping process at an offshore oil or gas well, comprising:

transporting liquid nitrogen pumping and vaporizing equipment on a floating vessel to an offshore oil or gas well location, the equipment disposed at a first situs on the vessel;

operating the equipment at the offshore well location so that liquid nitrogen is pumped, vaporized and flowed through a conduit of the equipment to a location off the vessel;

sensing a first temperature in the conduit and generating a first measurement signal in response to the sensed first temperature;

sensing a second temperature in the conduit and generating a second measurement signal in response to the sensed second temperature;

sensing a pressure in the conduit and generating a third measurement signal in response to the sensed pressure;

sensing a flow rate in the conduit and generating a fourth measurement signal in response to the sensed flow rate;

communicating the first, second, third and fourth measurement signals to an electrical controller disposed at a second situs on the vessel remote from the first situs;

generating an electrical control signal in the controller in response to at least one of the four measurement signals; and communicating the control signal from the controller at the second situs on the vessel to a pumping control apparatus of the equipment at the first situs on the vessel so that the pumping control apparatus responds to the control signal and stops the pumping of liquid nitrogen at the first situs.

17. A method as defined in claim 16, wherein generating the electrical control signal includes determining whether at least one of at least two conditions exists, wherein one condition exists when the first measurement signal represents a first temperature less than a predetermined temperature setpoint and another condition exists when the third measurement signal represents pressure greater than a predetermined pressure setpoint, and further wherein sensing the first temperature occurs upstream of sensing the second temperature relative to the flow of vaporized nitrogen through the conduit.

18. A method as defined in claim 17, further comprising generating a warning signal in response to either the first or third measurement signal when the sensed first temperature is less than a second predetermined temperature setpoint or when the sensed pressure is greater than a second predetermined pressure setpoint.

19. A method as defined in claim 16, further comprising generating in the controller an electrical data signal representing vaporized nitrogen volume in response to the second, third and fourth measurement signals, and displaying at the second situs the vaporized nitrogen volume in response to the data signal.

20. A method as defined in claim 19, further comprising communicating the data signal to a third situs remote from the first situs and the second situs.

* * * * *